US008220905B2

(12) United States Patent
Sugahara

(10) Patent No.: US 8,220,905 B2
(45) Date of Patent: Jul. 17, 2012

(54) LIQUID TRANSPORTING APPARATUS AND METHOD OF PRODUCING LIQUID TRANSPORTING APPARATUS

(75) Inventor: Hiroto Sugahara, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 1284 days.

(21) Appl. No.: 11/894,235

(22) Filed: Aug. 20, 2007

(65) Prior Publication Data

US 2008/0049077 A1 Feb. 28, 2008

(30) Foreign Application Priority Data

Aug. 23, 2006 (JP) ..... 2006-226439

(51) Int. Cl.
*B41J 2/045* (2006.01)
*B41J 2/05* (2006.01)

(52) U.S. Cl. ..... 347/70; 347/50; 347/58; 347/71

(58) Field of Classification Search ..... 347/68, 347/70–72, 50, 57, 58
See application file for complete search history.

(56) References Cited

U.S. PATENT DOCUMENTS

| | | | | |
|---|---|---|---|---|
| 5,889,539 | A | 3/1999 | Kamoi et al. | |
| 5,992,976 | A | 11/1999 | Kimura et al. | |
| 7,149,090 | B2 | 12/2006 | Suzuki et al. | |
| 7,207,653 | B2 | 4/2007 | Ito | |
| 2002/0149652 | A1 * | 10/2002 | Sakamoto et al. | 347/68 |
| 2005/0057613 | A1 | 3/2005 | Watanabe | |
| 2005/0062807 | A1 | 3/2005 | Ito et al. | |
| 2005/0068379 | A1 | 3/2005 | Sanada | |
| 2005/0190232 | A1 | 9/2005 | Lee et al. | |
| 2005/0190241 | A1 * | 9/2005 | Lee et al. | 347/70 |
| 2006/0061631 | A1 * | 3/2006 | Yokouchi | 347/68 |
| 2006/0061633 | A1 | 3/2006 | Nakayama | |
| 2006/0103268 | A1 * | 5/2006 | Sugahara | 310/348 |
| 2006/0132547 | A1 | 6/2006 | Sugahara | |
| 2006/0170735 | A1 * | 8/2006 | Hong et al. | 347/68 |
| 2006/0244343 | A1 * | 11/2006 | Sugahara | 310/341 |
| 2007/0024676 | A1 * | 2/2007 | Kachi et al. | 347/68 |
| 2007/0144000 | A1 * | 6/2007 | Hirota et al. | 29/890.1 |

(Continued)

FOREIGN PATENT DOCUMENTS

JP 10264392 10/1998

(Continued)

OTHER PUBLICATIONS

Japanese Office Action for JP Patent Application No. 2007-209151, mailed Nov. 22, 2011 and English-language translation thereof.

*Primary Examiner* — Ryan Lepisto
*Assistant Examiner* — Hung Lam
(74) *Attorney, Agent, or Firm* — Frommer Lawrence & Haug LLP

(57) ABSTRACT

A liquid transporting apparatus includes a channel unit having a plurality of pressure chambers, a piezoelectric actuator having a vibration plate, a plurality of piezoelectric elements, a first electrode and second electrodes, and a flexible wiring member connected to the second electrodes. A support section is provided on the surface of the vibration plate, not facing the pressure chambers. A surface of the support section which does not face the vibration plate is joined to the flexible wiring member to support the flexible wiring member.

21 Claims, 15 Drawing Sheets

U.S. PATENT DOCUMENTS

2007/0195134 A1* 8/2007 Lee et al. ..... 347/72

FOREIGN PATENT DOCUMENTS

| | | |
|---|---|---|
| JP | 2000127391 | 5/2000 |
| JP | 2003086912 | 3/2003 |
| JP | 2003-341060 | 12/2003 |
| JP | 2004276487 | 10/2004 |
| JP | 2005041052 | 2/2005 |
| JP | 2005-059339 | 3/2005 |
| JP | 2005-074722 | 3/2005 |
| JP | 2005125773 | 5/2005 |
| JP | 2005-254721 | 9/2005 |
| JP | 2005238846 | 9/2005 |
| JP | 2005254721 | 9/2005 |
| JP | 2006-82480 | 3/2006 |
| JP | 2006-192893 | 7/2006 |

* cited by examiner

LIQUID TRANSPORTING APPARATUS AND METHOD OF PRODUCING LIQUID TRANSPORTING APPARATUS

CROSS REFERENCE TO RELATED APPLICATION

The present application claims priority from Japanese Patent Application No. 2006-226439, filed on Aug. 23, 2006, the disclosure of which is incorporated herein by in its entirety.

BACKGROUND OF THE INVENTION

1. Field of the Invention

The present invention relates to a liquid transporting apparatus and a method of producing a liquid transporting apparatus.

2. Description of the Related Art

Conventionally, as an ink-jet head jetting ink droplets, there has been known an ink-jet head including a piezoelectric actuator which applies a jetting pressure to ink in pressure chambers constituting part of ink channels.

For example, an ink-jet head shown in FIG. 4 of U.S. Patent Application Publication No. US 2005/0068379 A1 (corresponding to Japanese Patent Application Laid-open No. 2005-125773) includes: a channel unit in which a plurality of nozzles and channels including a plurality of pressure chambers communicating with the nozzles respectively and so on are formed; and a piezoelectric actuator disposed on a surface of the channel unit. The piezoelectric actuator includes: a vibration plate covering the pressure chambers; and a plurality of stacked piezoelectric elements discretely arranged on areas, of the vibration plate, facing the pressure chambers. In each of the piezoelectric elements, a plurality of internal electrodes are provided to cause an electric field to act in a thickness direction, and these internal electrodes are electrically conducted with individual electrodes on surfaces of the piezoelectric elements and with the vibration plate as a common electrode of the piezoelectric elements. Further, a flexible wiring member (flexible board (FPC)) is electrically connected to the individual electrodes of the piezoelectric elements. When a driving voltage is applied to the individual electrodes via the FPC, the piezoelectric elements contracts in the stacking direction, and accordingly, the vibration plate deforms to change an inner volume of the pressure chamber, thereby applying the pressure to the ink in the pressure chamber. In the piezoelectric actuator with such a structure, since the piezoelectric elements adjacent to each other are separated, the deformation of the piezoelectric elements to which the driving voltage is applied does not easily spread to the adjacent piezoelectric elements, which is advantageous in that crosstalk is small.

In U.S. Patent Application Publication No. US 2005/0068379 as described above, however, since the FPC supplying the driving voltage to the piezoelectric actuator is bonded only by solder or the like to the individual electrodes of the discretely arranged piezoelectric elements, a bonding area between the FPC and the piezoelectric elements is small. Therefore, the FPC easily peels off from the piezoelectric elements when some external force acts on the FPC during production processes. Further, the external force acting on the FPC may act locally on a specific one of the piezoelectric elements to break the piezoelectric element. This has been one of causes of a decrease in production yields. Further, since the piezoelectric elements are provided on the vibration plate to be isolated from one another, a bonding area between the vibration plate and each of the piezoelectric elements is small. Therefore, when an external force acts between the piezoelectric elements and the vibration plate on which the piezoelectric elements are provided, the piezoelectric elements may peel off separately from the vibration plate.

SUMMARY OF THE INVENTION

It is an object of the present invention to provide a liquid transporting apparatus in which the peeling of a wiring member connected to electrodes provided on surfaces of piezoelectric elements and damages of the piezoelectric elements can be prevented as much as possible when an external force acts on the wiring member, and a method of producing the liquid transporting apparatus. It should be noted that the parenthesized reference numerals and symbols assigned to respective elements shown below are only examples of the elements, and are not intended to limit the elements.

According to a first aspect of the present invention, there is provided a liquid transporting apparatus including: a channel unit (4) in which a liquid channel including a plurality of pressure chambers (14) arranged along a plane is formed; a piezoelectric actuator (5) which applies a pressure to a liquid in the pressure chambers (14) and which includes a vibration plate (30) disposed on the channel unit (4) to cover the pressure chambers, a plurality of piezoelectric elements (31) disposed on a surface, of the vibration plate (30), not facing the pressure chambers (14), a first electrode disposed on the surface, of the vibration plate (30), which is in contact with the piezoelectric elements (31), and second electrodes (32) disposed on surfaces, of the piezoelectric elements, opposite to surfaces of the piezoelectric elements which are in contact with the vibration plate (30); and a flexible wiring member connected to the second electrodes; wherein each of the piezoelectric elements (31) is disposed to face one of the pressure chambers (14) corresponding thereto and the piezoelectric elements are arranged to be isolated from each other; a support section (36) is arranged on the surface, of the vibration plate (30), not facing the pressure chambers (14), at an area different from another area facing the pressure chambers (14), the support section (36) being made of a piezoelectric material same as that of the piezoelectric elements (31); and a surface of the support section (36) which does not face the vibration plate (30) is joined to the wiring member (50) to support the flexible wiring member (50).

In this liquid transporting apparatus, when a driving voltage is applied between the first electrode and the second electrode via the wiring member, the piezoelectric element disposed between these first and second electrodes are deformed, and accordingly the vibration plate deforms. At this time, due to a change in an inner volume of the pressure chamber, a pressure is applied to the liquid in the pressure chamber. Here in the present invention, on the surface, of the vibration plate, not facing the pressure chambers, the support section made of the same piezoelectric material as that of the piezoelectric elements is provided on the area different from another area facing the pressure chambers, and the wiring member is joined or bonded to the support section. That is, the wiring member is joined to the piezoelectric actuator at the support section as well as at connection portions with the second electrodes. This makes it difficult for the wiring member to peel off from the piezoelectric actuator when an external force acts on the wiring member. Here, being made of the same piezoelectric material, the piezoelectric elements and the support sections have the same coefficient of thermal expansion. Even if the liquid transporting apparatus is repeatedly used under the presence of a temperature change, a stress ascribable to a difference in coefficient of thermal expansion is unlikely to occur in a joining or bonding portion between the wiring member and the plural support sections. Therefore, even if an external force acts on the wiring member, the wiring member does not easily peel off from the support section and the support section does not easily peel off from the vibration plate. Further, production yields can be improved since it is possible to prevent that the external force acting on the wiring member acts locally on a specific one of the piezoelectric elements to break the piezoelectric element. Further, it is possible to simplify production processes since the support section and the piezoelectric elements, which are made of the same piezoelectric material, can be simultaneously formed. It should be noted that the present invention includes a form where, in the vibration plate, at least the surface not facing the pressure chambers is conductive and this conductive surface serves as the first electrode. Further, in the present application, "joined to the surface, of the support section, not facing the vibration plate" includes not only direct joining of the wiring member to the support section but also indirect joining of the wiring member to the support section via other member such as a surface electrode.

In the liquid transporting apparatus of the present invention, the area at which the support section (36) is arranged may be outside the another area facing the pressure chambers (14). According to this structure, the wiring member is more difficult to peel off since the support section is disposed on the area on the outer side of the another area facing the pressure chamber, namely, on the area where a large external force easily acts on the wiring member, and the wiring member is fixed to the support section.

In the liquid transporting apparatus of the present invention, the area at which the support section (36) is arranged may surround the another area facing the pressure chambers (14). According to this structure, the wiring member is still more difficult to peel off since the support section is disposed to surround the another area facing the pressure chambers and the wiring member is fixed to the support section.

In the liquid transporting apparatus of the present invention, the first electrode may be a common electrode of the piezoelectric elements (31), formed without any gap on the surface, of the vibration plate (30), not facing the pressure chambers (14); and the second electrodes (32) may be individual electrodes of the piezoelectric elements (14) respectively. In a case where the second electrodes are the individual electrodes, the wiring member is connected individually to the individual electrodes, and since a driving voltage is applied selectively to the individual electrodes when the piezoelectric actuator is driven, the sure connection between the wiring member and each of the individual electrodes is necessary. In such a case, especially because the wiring member is fixed to the support section and thus is prevented from peeling off, the electrical connection necessary for applying the driving voltage to the individual electrodes is reliably ensured.

In the liquid transporting apparatus of the present invention, the vibration plate (30) may have a conductive surface as the common electrode provided on the surface, of the vibration plate, not facing the pressure chambers (14); a surface electrode (37) may be formed on the surface of the support section not facing the vibration plate (30), and the surface electrode (37) may be electrically conducted with the conductive surface of the vibration plate (30); and the wiring member (50) may be electrically connected to the surface electrode (37). According to this structure, the common electrode facing the individual electrodes to generate the electric field in the piezoelectric elements need not be provided separately from the vibration plate since the vibration plate has the conductive surface provided at a side opposite to the pressure chambers. Further, it is possible to apply a predetermined reference potential to the conductive surface as the common electrode since the wiring member is electrically connected to the conductive surface of the vibration plate via the surface electrode.

In the liquid transporting apparatus of the present invention, the wiring member (50) may be joined to the surface, of the support section (36), not facing the vibration plate (30) by a thermosetting adhesive (40). The joining by the thermosetting adhesive more surely prevents the peeling of the wiring member than solder bonding because of its higher joining strength than the solder bonding. Further, owing to the thermosetting property of the adhesive, the joining of the wiring member and the support section can proceed simultaneously with the heating/melting of solder for joining the second electrodes and the wiring member.

In the liquid transporting apparatus of the present invention, the thermosetting adhesive (40) may be electrically conductive. The wiring member is connected to the surface electrode via the thermosetting adhesive, and the surface electrode and the conductive surface of the vibration plate are electrically conductive to each other. Therefore, it is possible to constantly keep the potential of the vibration plate at a ground potential by a control unit connected to the wiring member.

In the liquid transporting apparatus of the present invention, the support section (36) may extend in an extending direction which is a longitudinal direction of the wiring member (50). This allows the support section to be used as a plane, and therefore, a conduction part via which the surface electrode and the vibration plate are electrically conducted to each other can be provided at any position in the longitudinal direction of the support section.

In the liquid transporting apparatus of the present invention, a width of the support section (36) in an orthogonal direction orthogonal to the extending direction of the support section (36) may vary in the extending direction of the support section (36). This can increase a joining area between the support section and the wiring member.

The liquid transporting apparatus of the present invention may be an ink-jet head.

According to a second aspect of the present invention, there is provided a method of producing a liquid transporting apparatus including a piezoelectric actuator (5), the method including: a step of preparing a channel unit (4) having a liquid channel including a plurality of pressure chambers (14) which are arranged along a plane; a step of disposing a vibration plate (30) on the channel unit (4) to cover the pressure chambers (14); an element-forming step of forming a plurality of piezoelectric elements (31) which are isolated from each other by discretely depositing particles of a piezoelectric material on a surface, of the vibration plate (30), not facing the pressure chambers (14); a first electrode-forming step of forming a first electrode on the surface, of the vibration plate (30), which is in contact with the piezoelectric elements (31); a second electrode-forming step of forming second electrodes (32) on surfaces, of the piezoelectric elements (31), opposite to surfaces of the piezoelectric elements which are in contact with the vibration plate (30); and a wiring-connecting step of connecting a flexible wiring member (50) to the second electrodes (32); wherein in the element-forming step, a support section (36) made of a piezoelectric material same as that of the piezoelectric elements (31) is formed on the surface, of the vibration plate (30), not facing the pressure chambers (14) simultaneously with the formation of the piezoelectric elements (31); and in the wiring-connecting step, the wiring member (50) is joined to a surface, of the support section (36), not facing the vibration plate (30), together with the connection of the wiring member (50) to the second electrodes (32).

According to the method of producing the liquid transporting apparatus, in the element-forming step, the piezoelectric elements and the support section made of the same piezoelectric material as that of the piezoelectric elements are formed on the surface, of the vibration plate, not facing the pressure chambers, and in the wiring-connecting step, the wiring member is connected to the second electrodes and also is joined to the support section. That is, the wiring member is joined to the piezoelectric actuator not only at connection portions with the second electrodes but also at the support section. Therefore, the wiring member does not easily peel off from the piezoelectric actuator when an external force acts on the wiring member. Further, production yields are improved since it is possible to prevent that the external force acting on the wiring member acts locally on a specific one of the piezoelectric elements to break the piezoelectric element. Moreover, the simultaneous formation of the piezoelectric elements and the support section can simplify production processes. It should be noted that this producing method also includes a form where at least the surface, of the vibration plate, not facing the pressure chambers is conductive and this conductive surface serves as the first electrode.

In the method of producing the liquid transporting apparatus of the present invention, in the element-forming step, the support section (36) may be formed on an area, of the vibration plate (30), located outside another area of the vibration plate facing the pressure chambers (14). The wiring member is more difficult to peel off since the support section is thus formed on the area located outside the another area of the vibration plate facing the pressure chambers, that is, on an area where a large external force easily acts on the wiring member, and the wiring member is joined to the support section.

In the method of producing the liquid transporting apparatus of the present invention, the first electrode may be formed without any gap on the surface, of the vibration plate (30), not facing the pressure chambers (14) and may be a common electrode of the piezoelectric elements (31); the second electrodes (32) may be individual electrodes of the piezoelectric elements (31) respectively; the vibration plate (30) may have a conductive surface, as the common electrode, on a side opposite to the pressure chambers (14); in the second electrode-forming step, a surface electrode (37) may be formed on the surface, of the support section (36), not facing the vibration plate (30), together with the formation of the individual electrodes, and a conduction part (38) via which the surface electrode (37) and the conductive surface of the vibration plate (30) are electrically conducted to each other may be formed; and in the wiring-connecting step, the wiring member (50) and the surface electrode (37) may be electrically connected.

In a case where the vibration plate thus has the conductive surface on the side opposite to the pressure chambers and this conductive surface serves as the common electrode, the common electrode facing the individual electrodes to generate an electric field in the piezoelectric elements need not be separately provided. Further, it is possible to apply a predetermined reference potential to the conductive surface as the common electrode since the wiring member is electrically connected to the conductive surface of the vibration plate via the surface electrode.

In the method of producing the liquid transporting apparatus of the present invention, in the wiring-connecting step, a thermosetting adhesive (40) may be used to join the wiring member (50) to the surface, of the support section (36), not facing the vibration plate (30). The joining by the thermosetting adhesive can more surely prevent the peeling of the wiring member than solder bonding owing to its higher joining strength than that of the solder bonding. Further, because of a thermosetting property of the adhesive, the joining of the wiring member and the support section can proceed simultaneously with the melting/heating of solder for joining the second electrodes and the wiring member.

In the method of producing the liquid transporting apparatus of the present invention, the thermosetting adhesive may be electrically conductive. The wiring member is connected to the surface electrode via the thermosetting adhesive, and the surface electrode and the conductive surface of the vibration plate are electrically conducted. Therefore, it is possible to constantly keep the potential of the vibration plate at a ground potential by a control unit connected to the wiring member.

In the method of producing the liquid transporting apparatus of the present invention, the support section may be formed to extend in an extending direction which is a longitudinal direction of the wiring member. This allows the support section to be used as a plane, and therefore, the conduction part via which the surface electrode and the vibration plate are electrically conducted to each other can be provided at any position in the longitudinal direction of the support section.

In the method of producing the liquid transporting apparatus of the present invention, a width of the support section in an orthogonal direction orthogonal to the extending direction of the support section may vary in the longitudinal direction. This can increase a joining area between the support section and the wiring member.

In the method of producing the liquid transporting apparatus of the present invention, the liquid transporting apparatus may be an ink-jet head.

According to the present invention, on the surface, of the vibration plate, not facing the pressure chambers, the support section made of the same piezoelectric material as that of the piezoelectric elements are provided on the area different from the another area facing the pressure chambers, and the wiring member is joined to the support section. That is, the wiring member is joined to the piezoelectric actuator at the support section as well as at the connection portions with the second electrodes. Therefore, the wiring member does not easily peel off from the piezoelectric actuator when an external force acts on the wiring member. Further, production yields are improved since it can be prevented that the external force acting on the wiring member acts locally on a specific one of the piezoelectric elements to break the piezoelectric element. Moreover, the simultaneous formation of the piezoelectric elements and the support section is possible since the support section is made of the same piezoelectric material as that of the piezoelectric elements.

DETAILED DESCRIPTION OF THE PREFERRED EMBODIMENTS

An embodiment of the present invention will be explained. This embodiment is an example where the present invention is applied to an ink-jet head, as the liquid transporting apparatus, which applies a pressure to an ink to transport the ink to nozzles and jets ink droplets to a recording paper from the nozzles to record desired images, characters, and so forth on the recording paper.

Figure 1:
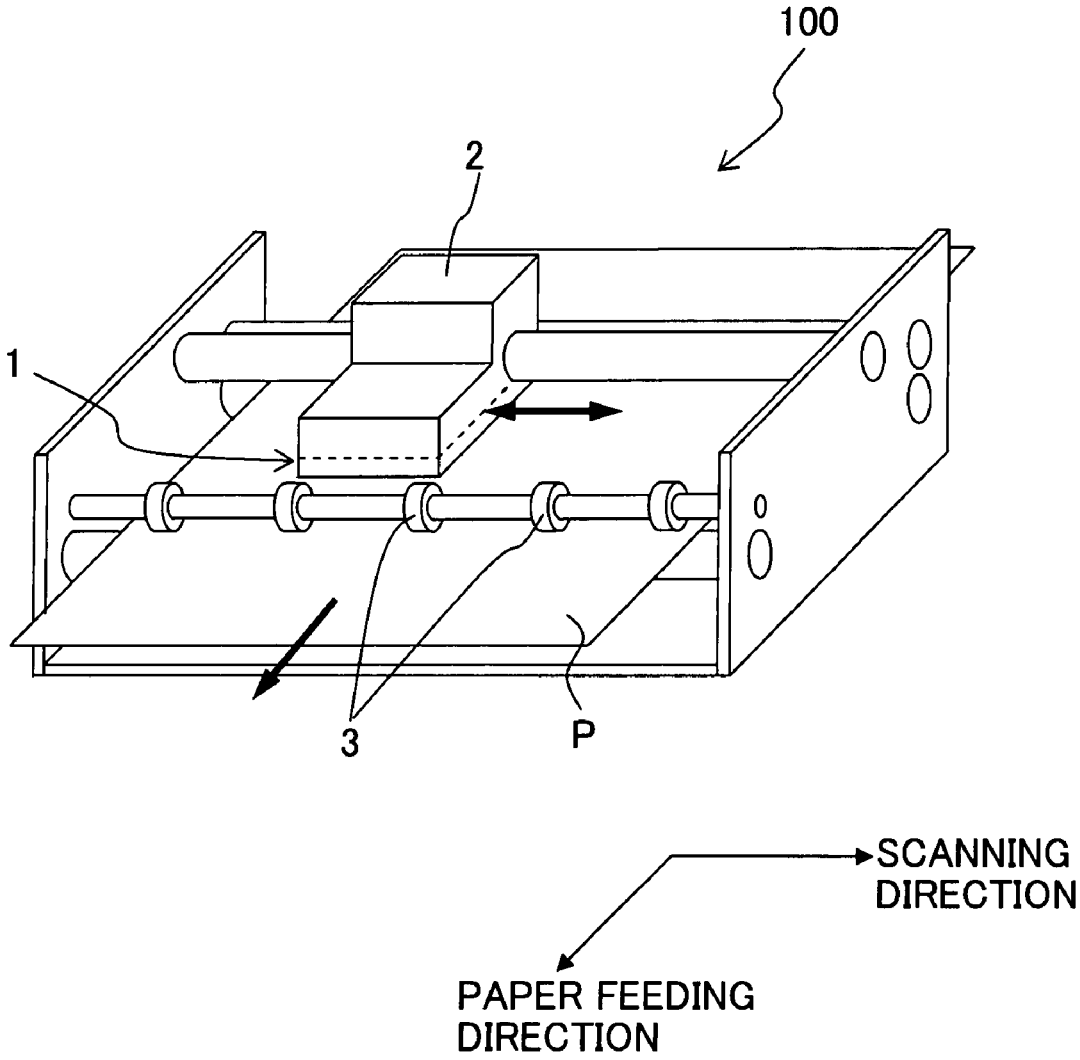
FIG. 1 is a view showing the rough structure of an ink-jet printer according to an embodiment of the present invention.

First, an ink-jet printer including the ink-jet head of this embodiment will be briefly explained. As shown in FIG. 1, an ink-jet printer 100 includes: a carriage 2 movable in a right and left direction in FIG. 1; a serial-type ink-jet head 1 provided in the carriage 2 to jet an ink to a recording paper P; a feeding roller 3 sending the recording paper P in a forward direction in FIG. 1; and so on. The ink-jet head 1 moves integrally with the carriage 2 in the right and left direction (scanning direction) and jets the ink to the recording paper P from nozzles 20 (see FIG. 2 to FIG. 5) disposed on a lower surface of the ink-jet head 1, thereby recording desired characters, images, and so on. Further, the recording paper P on which the images and so on are recorded by the ink-jet head 1 is discharged in the forward direction (paper feeding direction) by the feeding roller 3.

Next, the ink-jet head 1 will be explained. As shown in FIG. 2 to FIG. 5, the ink-jet head 1 includes: a channel unit 4 in which the nozzles 20 and ink channels including pressure chambers 14 are formed; and a piezoelectric actuator 5 applying a jetting pressure to an ink in each of the pressure chambers 14.

Figure 4:
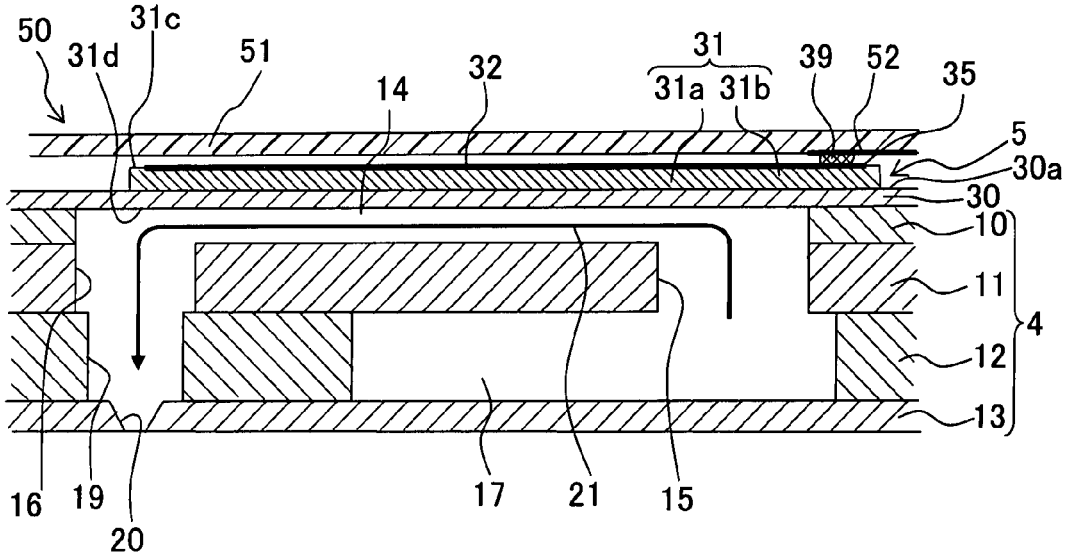
FIG. 4 is a cross-sectional view taken along line IV-IV in FIG. 3.
Figure 5:
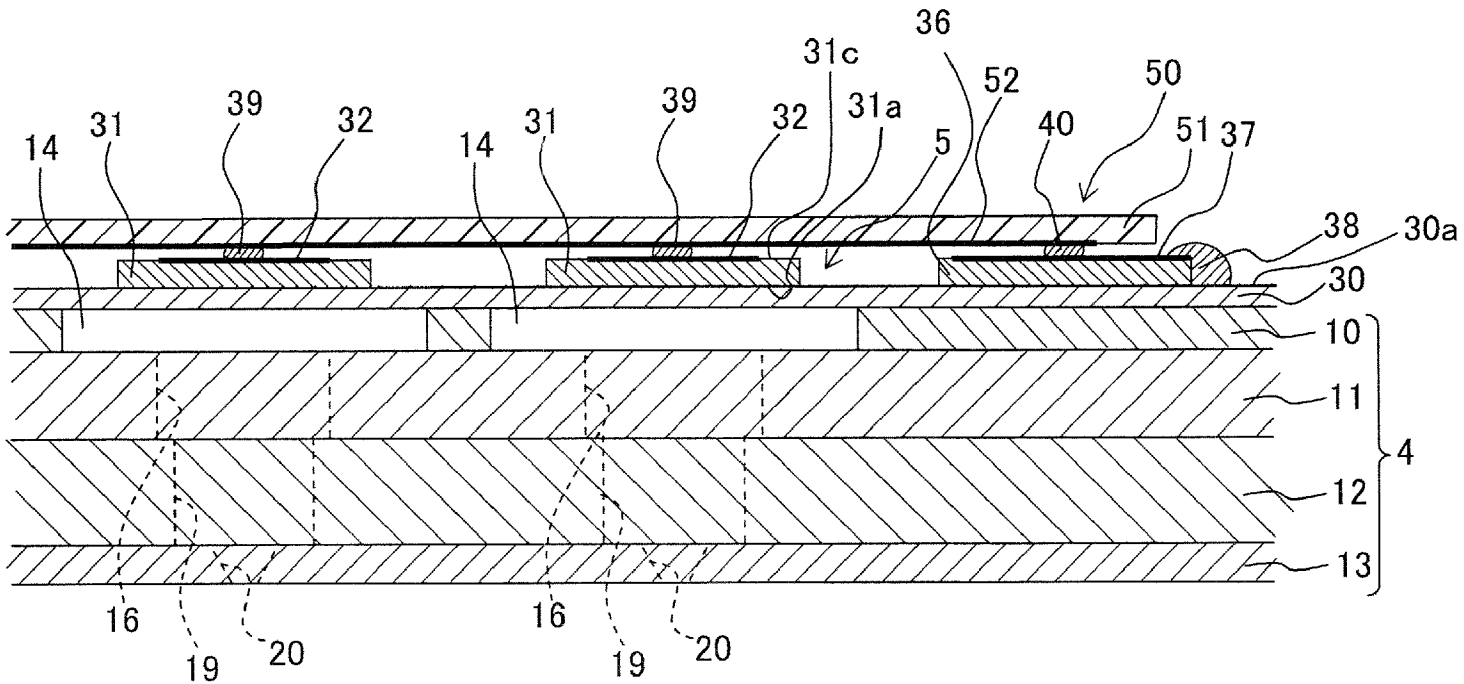
FIG. 5 is a cross-sectional view taken along line V-V in FIG. 3.

First, the channel unit 4 will be explained. As shown in FIG. 4 and FIG. 5, the channel unit 4 includes a cavity plate 10, a base plate 11, a manifold plate 12, and a nozzle plate 13, and these four plates 10 to 13 are bonded together in a stacked state. Among these plates, the cavity plate 10, the base plate 11, and the manifold plate 12 are stainless steel plates, and the ink channels such as manifolds 17 (to be described later) and the pressure chambers 14 can be easily formed in these three plates 10 to 12 by etching. Further, the nozzle plate 13 is made of a synthetic polymeric resin material such as, for example, polyimide and is bonded to a lower surface of the manifold plate 12. Alternatively, this nozzle plate 13 may be made of a metal material such as stainless steel similarly to the three plates 10 to 12.

As shown in FIG. 2 to FIG. 5, in the uppermost cavity plate 10 among the four plates 10 to 13, the pressure chambers 14 arranged along a plane are formed as holes penetrating the plate 10. Further, the pressure chambers 14 are arranged in two rows and in a zigzag pattern, the pressure chambers 14 in each of the rows being arranged in the paper feeding direction (up and down direction in FIG. 2). These pressure chambers 14 are covered by a vibration plate 30 (to be described later) and the base plate 11 from upper and lower sides respectively. Further, each of the pressure chambers 14 has a substantially elliptical form which is long in the scanning direction (right and left direction in FIG. 2) in a plan view.

Figure 3:
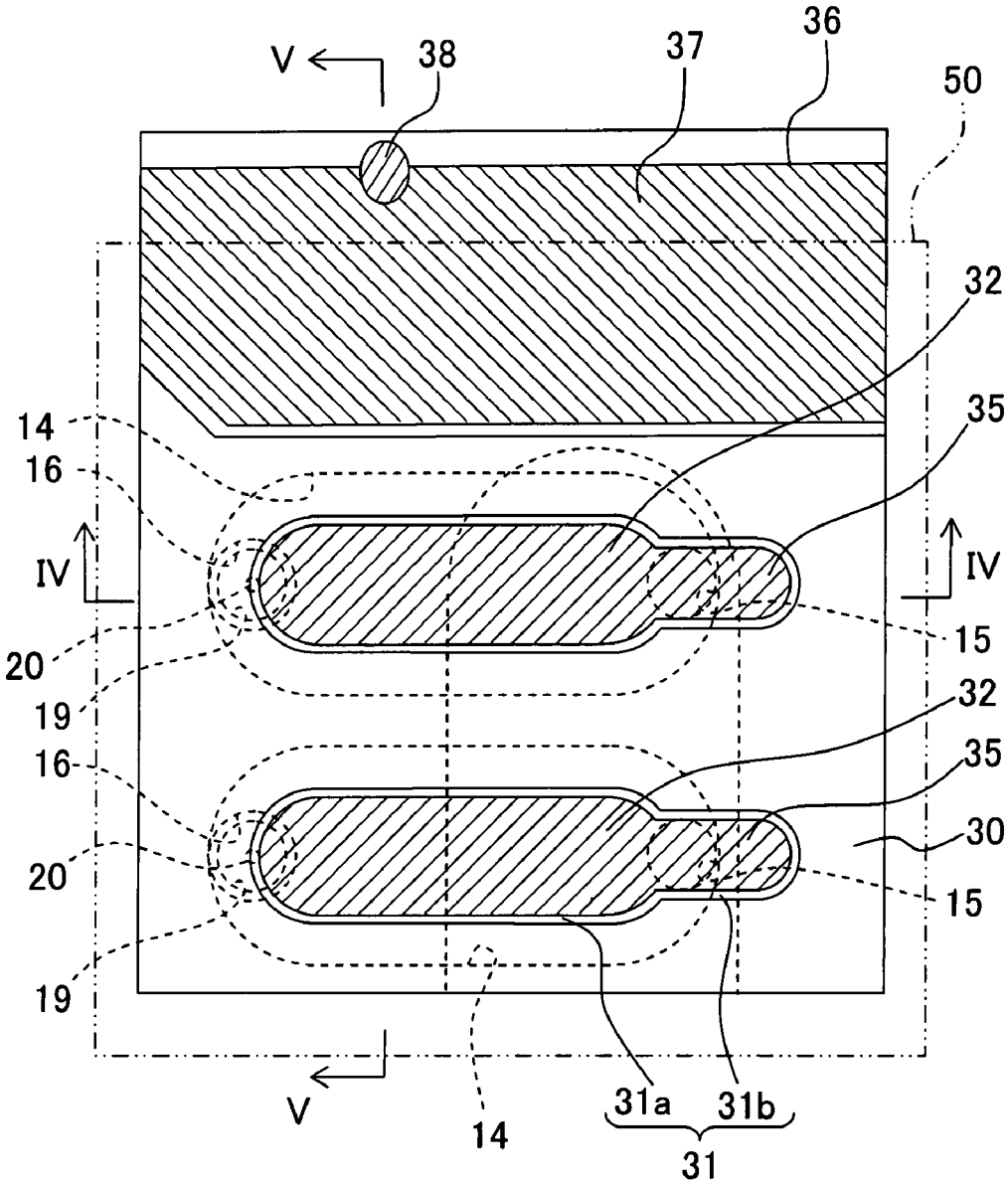
FIG. 3 is a partial enlarged view of FIG. 2.

As shown in FIG. 3 and FIG. 4, in the base plate 11, communication holes 15, 16 are formed at positions overlapping with both end portions of the pressure chambers 14 respectively in a plan view. Further, in the manifold plate 12, two manifolds 17 extending in the paper feeding direction are formed to overlap, in a plan view, with communication hole 15 side portions of the pressure chambers 14 arranged in two rows. These two manifolds 17 communicate with an ink supply port 18 formed in the vibration plate 30 (to be described later), and the ink is supplied to the manifolds 17 via the ink supply port 18 from an ink tank (not shown). In the manifold plate 12, a plurality of communication holes 19 communicating with the communication holes 16 are also formed at positions which, in a plan view, overlap with end portions of the pressure chambers 14 on a side opposite the manifolds 17.

Figure 2:
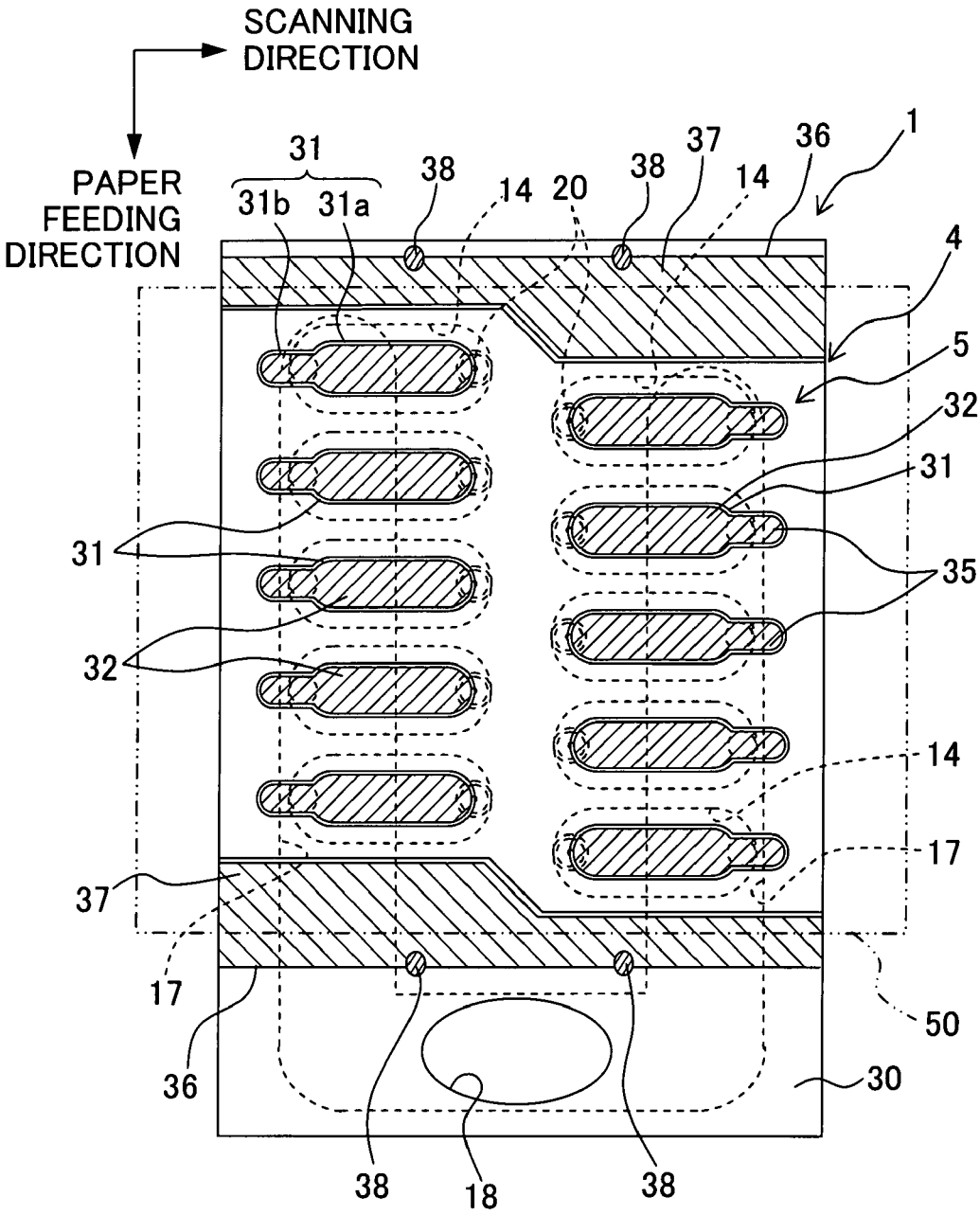
FIG. 2 is a plan view of an ink-jet head.

Further, in the nozzle plate 13, the nozzles 20 are formed respectively at positions which, in a plan view, overlap with the communication holes 19. As shown in FIG. 2, the nozzles 20 are arranged in the paper feeding direction so as to overlap with the end portions of the pressure chambers 14 arranged in two rows, on a side opposite the manifolds 17, respectively. That is, the plural nozzles 20 are arranged in two rows and in the zigzag pattern so as to correspond to the pressure chambers 14 respectively.

As shown in FIG. 4, the manifolds 17 communicate with the pressure chambers 14 via the communication holes 15, and the pressure chambers 14 further communicate with the nozzles 20 via the communication holes 16, 19. In this manner, in the channel unit 4, a plurality of individual ink channels 21 are formed, each extending from the manifold 17 to the nozzle 20 via the pressure chamber 14.

Next, the piezoelectric actuator 5 will be explained. As shown in FIG. 2 to FIG. 5, the piezoelectric actuator 5 has: the vibration plate 30 disposed on an upper surface of the cavity plate 10 to cover the pressure chambers 14; a plurality of piezoelectric elements 31 disposed on areas facing the pressure chambers 14 respectively, on an upper surface 30*a* (surface not facing the pressure chambers 14) of the vibration plate 30; and a plurality of individual electrodes 32 (second electrodes) disposed on upper surfaces 31*c* (surfaces not facing the vibration plate 30) of the piezoelectric elements 31 respectively. The piezoelectric elements 31 are isolated from one another and are dispersed in an island pattern on the upper surface 30*a* of the vibration plate 30.

The vibration plate 30 is a metal plate having a substantially rectangular form in a plan view. The vibration plate 30 is made of, for example, an iron alloy such as stainless steel, a copper alloy, a nickel alloy, a titanium alloy, or the like. The vibration plate 30 disposed on the upper surface of the cavity plate 10 to cover the pressure chambers 14 is bonded to the cavity plate 10. Further, the conductive upper surface 30*a* (conductive surface) of the vibration plate 30 is disposed on a lower surface 31*d* side of the piezoelectric elements 31, thereby serving also as a common electrode (first electrode) of the piezoelectric elements 31 to generate a width-direction electric field in the piezoelectric elements 31 between the common electrode and the individual electrodes 32 on the upper surfaces 31*c* of the piezoelectric elements 31. Therefore, there is no need to provide a common electrode separately from the vibration plate 30, which accordingly simplifies the structure of the piezoelectric actuator 5. Moreover, the vibration plate 30 as the common electrode is constantly kept at a ground potential which is a reference potential. The structure for this will be described later in detail.

Each of the piezoelectric elements 31 is made of a piezoelectric material whose major component is lead zirconate titanate (PZT) which is a solid solution of lead titanate and lead zirconate and is a ferroelectric. As shown in FIG. 2, the piezoelectric elements 31 are arranged in two rows, those in each of the rows being arranged in the paper feeding direction, so as to correspond to the pressure chambers 14 respectively. Each of the piezoelectric elements 31 has a substantially elliptical shape slightly smaller than the pressure chamber 14, and has: a driving portion 31*a* disposed on an area, of the upper surface 30*a* of the vibration plate 30, facing a center portion of each of the pressure chambers 14; and a contact arrangement portion 31*b* extending along a longitudinal direction of the driving portion 31*a* from one end portion (end portion on a right and left direction outer side in FIG. 2) of the driving portion 31*a* to protrude to an area outside a peripheral edge of the pressure chamber 14.

Further, on the upper surface 30*a* of the vibration plate 30, two support sections 36 made of the same piezoelectric material as that of the piezoelectric elements 31 are formed on areas on a paper feeding direction (up and down direction in FIG. 2) outer side of areas facing the pressure chambers 14 so as to sandwich the piezoelectric elements 31. These two support sections 36 are substantially equal in thickness to the piezoelectric elements 31. Further, surface electrodes 37 are formed so as to cover substantially entire upper surfaces of the two support sections 36. Further, on end surfaces of the two support sections 36 on the paper feeding direction outer sides, a plurality of conduction parts 38 made of a conductive material are provided to extend from the surface electrodes 37 disposed on the upper surfaces of the support sections 36 to the upper surface 30*a* (conductive surface) of the vibration plate 30 positioned under the support sections 36, and the surface electrodes 37 and the upper surface 30*a* of the vibration plate 30 are electrically conducted via the conduction parts 38.

Each of the individual electrodes 32 has a substantially elliptical shape in a plan view and is disposed on an upper surface of the driving portion 31*a* of the corresponding piezoelectric element 31 (upper surface 31*c* of the piezoelectric element 31). Further, contact portions 35 led out in the longitudinal direction from end portions of the individual electrodes 32 are disposed on the contact arrangement portions 31*b* of the piezoelectric elements 31. Tip portions of the contact portions 35 led out from the individual electrodes 32 are positioned on relatively highly stiff areas which are on an outer side of the peripheral edges of the pressure chambers 14 in a plan view.

As shown in FIG. 2 to FIG. 5, above the piezoelectric actuator 5, a flexible printed circuit (FPC) 50 as a flexible wiring member connected to a driver IC as a driving circuit (not shown) is disposed so as to cover the piezoelectric elements 31 (individual electrodes 32). The FPC 50 includes: a sheet substrate 51 made of an insulative and flexible material such as a synthetic resin material; and a plurality of wiring parts 52 formed on a lower surface, of the substrate 51, facing the individual electrodes 32. The wiring parts 52 of the FPC 50 and the contact portions 35 led out from the individual electrodes 32 respectively are electrically connected to each other by solder 39. This makes it possible to apply the driving voltage from the driver IC selectively to the individual electrodes 32 via the FPC 50.

Incidentally, some of the wiring parts 52 of the FPC 50 are not connected to the individual electrodes 32 but are mechanically joined or bonded by an adhesive 40 to the surface electrodes 37 formed on the two support sections 36. The adhesive 40 used here is, for example, a conductive, thermosetting adhesive made of thermosetting resin such as epoxy resin containing conductive particles. Therefore, the wiring parts 52 of the FPC 50 and the surface electrodes 37 are also electrically connected to each other via the adhesive 40, and as a result, the vibration plate 30 comes in electrical conduction with the driver IC via the wiring parts 52 of the FPC 50. By the driver IC, the potential of the vibration plate 30 serving as the common electrode of the piezoelectric elements 31 is constantly kept at the ground potential via the wiring parts 52 of the FPC 50, the surface electrodes 37, and the conduction parts 38.

As described above, the FPC 50 electrically connected to the contact portions 35 on the piezoelectric elements 31 are supported from under by the two support sections 36 equal in thickness to the piezoelectric elements 31 and is mechanically fixed to the two support sections 36 by the adhesive 40, and consequently, even when some external force acts on the FPC 50, the FPC 50 does not easily peel off from the piezoelectric elements 31, which enhances reliability of the electrical connection necessary for applying the driving voltage to the individual electrodes 32. Further, it can be prevented that the external force acting on the FPC 50 acts locally on a specific one of the piezoelectric elements 31 to break the piezoelectric element 31. Further, as shown in FIG. 2, the two support sections 36 are arranged at the areas located outside the areas where the pressure chambers 14 (piezoelectric elements 31) are disposed. That is, the FPC 50 is fixed by the two support sections 36 on the areas located outside the piezoelectric elements 31, namely, on areas where a large external force easily acts, and therefore, is more surely prevented from peeling off from the piezoelectric actuator 5. In particular, the piezoelectric elements 31 and the support sections 36 are made of the same piezoelectric material and are equal in coefficient of thermal expansion. Therefore, even if the inkjet head 1 is repeatedly used under the presence of a temperature change, a stress ascribable to a difference in the coefficient of thermal expansion is not likely to occur in joining portions between the FPC 50 and the support sections 36. Therefore, even when an external force acts on the FPC 50, the FPC 50 does not easily peel off from the support sections 36 and the support sections 36 do not easily peel off from the vibration plate 31.

Incidentally, to electrically and mechanically join the wiring parts 52 of the FPC 50 and the surface electrodes 37, solder may be used instead of the aforesaid conductive, thermosetting adhesive 40. However, because the solder is inferior in bonding strength to the thermosetting adhesive, it is preferable to join the FPC 50 and the support sections 36 to each other by the thermosetting adhesive in view of reliable joining of the both.

Next, the operation of the piezoelectric actuator 5 at the time when the ink is jetted will be explained. When the driver IC applies the driving voltage selectively to the individual electrodes 32 via the FPC 50, the individual electrode 32 to which the driving voltage is applied, among the individual electrodes 32 disposed on the upper side of the driving portions 31*a* of the piezoelectric elements 31 (on the upper surfaces 31*c* of the piezoelectric elements 31) becomes different in potential from the vibration plate 30 as the common electrode which is disposed on a lower side of the piezoelectric element 31 (on the lower surface 31*d* of the piezoelectric element 31) and is kept at the ground potential. Consequently, an electric field in the thickness direction is generated in the piezoelectric element 31 sandwiched between the individual electrode 32 and the vibration plate 30. Here, in a case where a polarization direction of the piezoelectric element 31 and the direction of the electric field are the same, the piezoelectric element 31 expands in the thickness direction, which is its polarization direction, to contract in a horizontal direction. Then, in accordance with the contraction deformation of the piezoelectric element 31, the vibration plate 30 deforms so that a portion thereof facing the pressure chamber 14 bulges toward the pressure chamber 14 side. At this time, since the volume of the pressure chamber 14 decreases, a pressure is applied to the ink in the pressure chamber 14 to cause the nozzle 20 communicating with the pressure chamber 14 to jet ink droplets.

Figure 6:
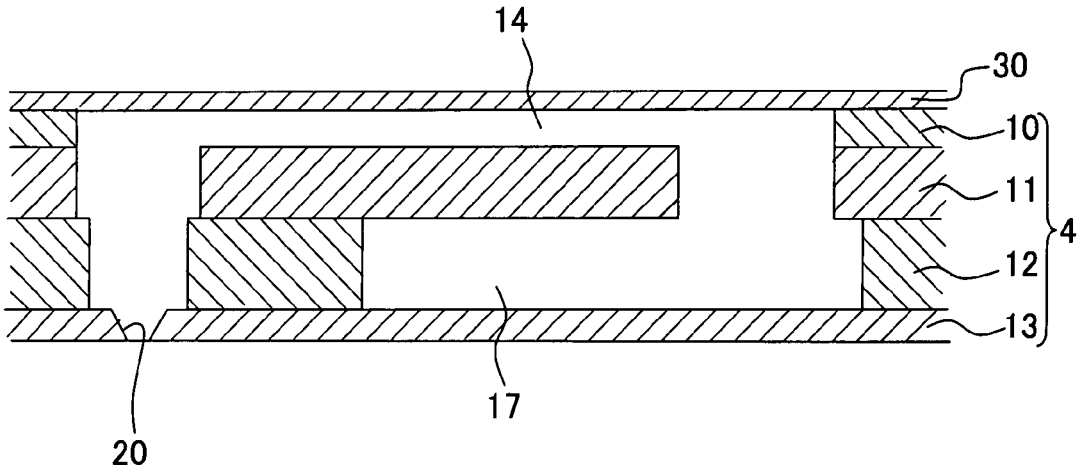
FIG. 6 is a cross-sectional view of the ink-jet head in the course of the manufacture in a state where plates forming a channel unit and a vibration plate are bonded.

Next, a method of producing the ink-jet head 1 will be explained. First, holes constituting part of the ink channels are formed in the four plates (the cavity plate 10, the base plate 11, the manifold plate 12, and the nozzle plate 13) constituting the channel unit 4 by etching, laser machining, or the like, and thereafter, as shown in FIG. 6, five plates, namely, the four plates 10 to 13 and the metal vibration plate 30 are stacked and joined by an adhesive, metal diffusion bonding, or the like.

Figure 7:
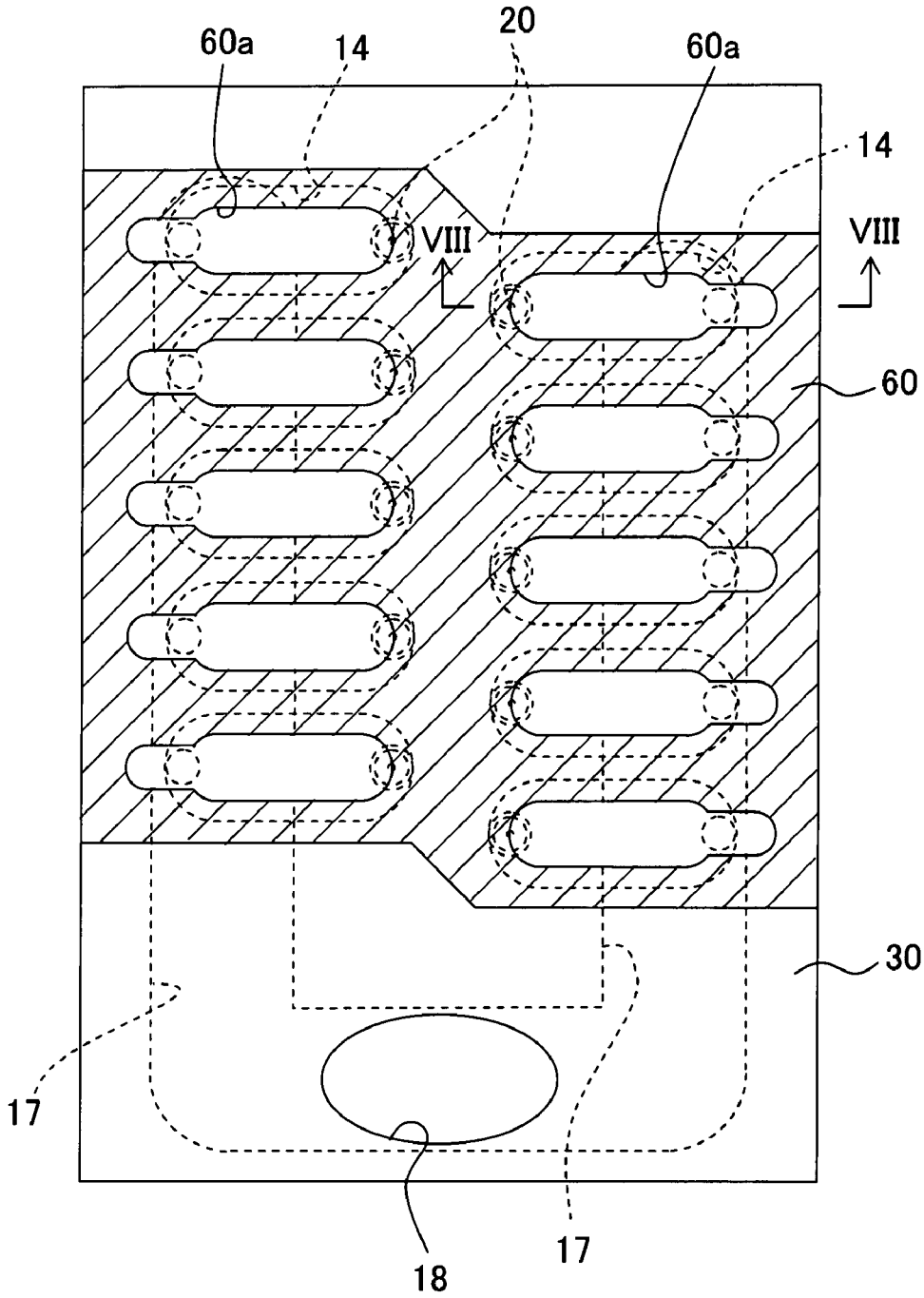
FIG. 7 is a plan view of the ink-jet head in a state where a mask is disposed on an upper surface of the vibration plate.
Figure 8:
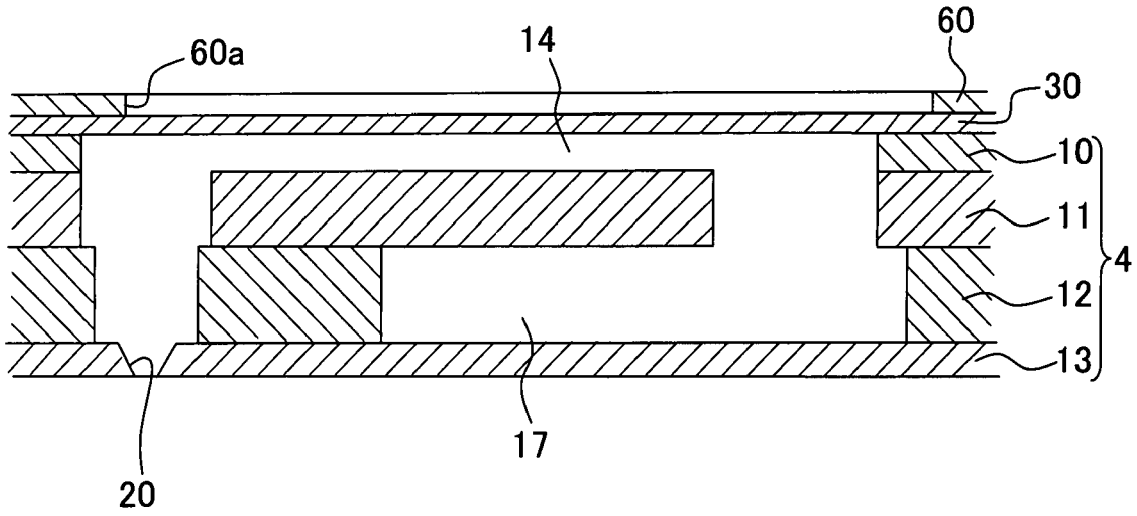
FIG. 8 is a cross-sectional view taken along line VIII-VIII in FIG. 7.
Figure 9:
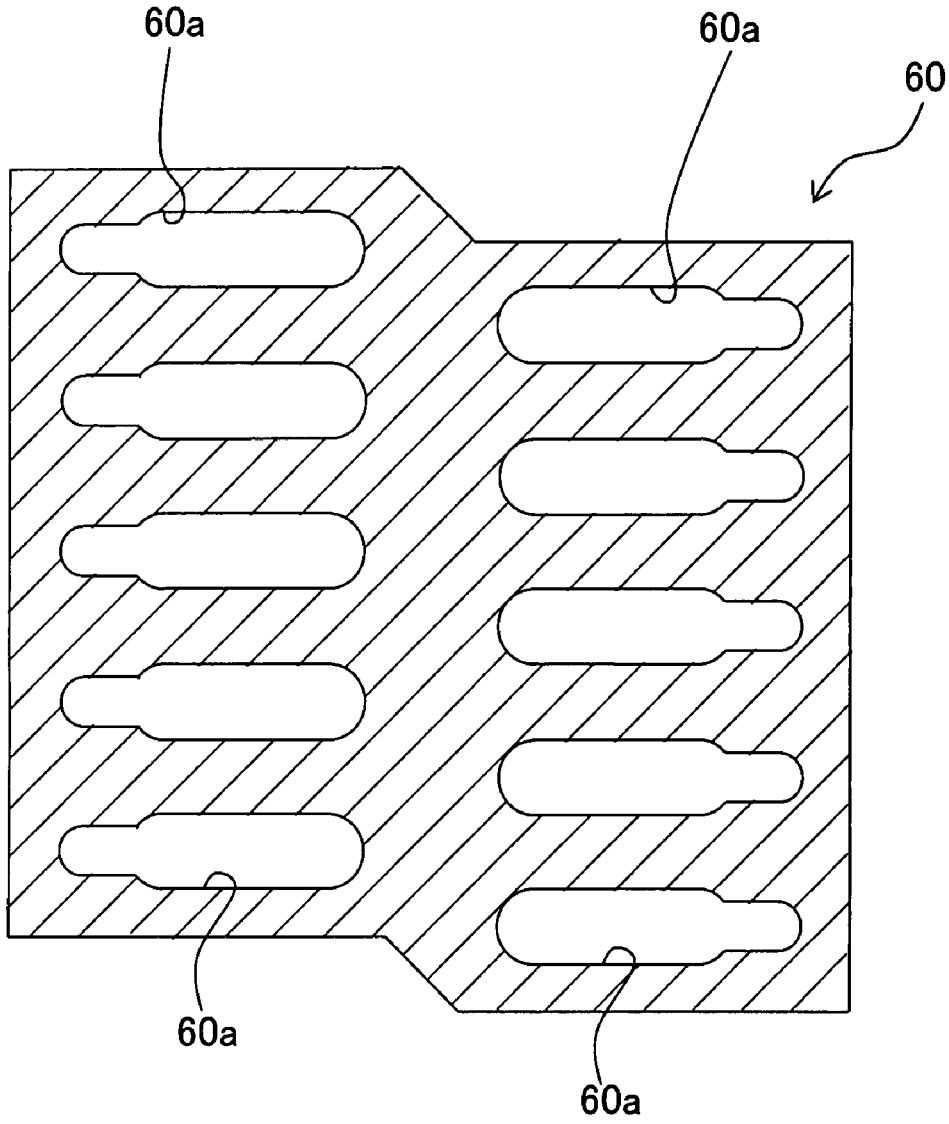
FIG. 9 is a plan view of the mask.

Next, as shown in FIG. 7 and FIG. 8, a mask 60 is placed on the upper surface of the vibration plate 30. As shown in FIG. 9, this mask 60 has a plurality of through holes 60*a* having a shape corresponding to the shape of the aforesaid piezoelectric elements 31, and these holes 60*a* are arranged in two rows so as to face the center portions of the pressure chambers 14 respectively when the mask 60 is placed on the upper surface of the vibration plate 30. Further, as shown in FIG. 7, the length of the mask 60 in the arrangement direction of the pressure chambers 14 is slightly longer than the length of one pressure chamber row and is shorter than the length of the vibration plate 30. Therefore, in the upper surface of the vibration plate 30, areas on which the holes 60*a* of the mask 60 are disposed and the both outer areas in the arrangement direction of the pressure chambers 14 are not covered by the mask 60.

Figure 10:
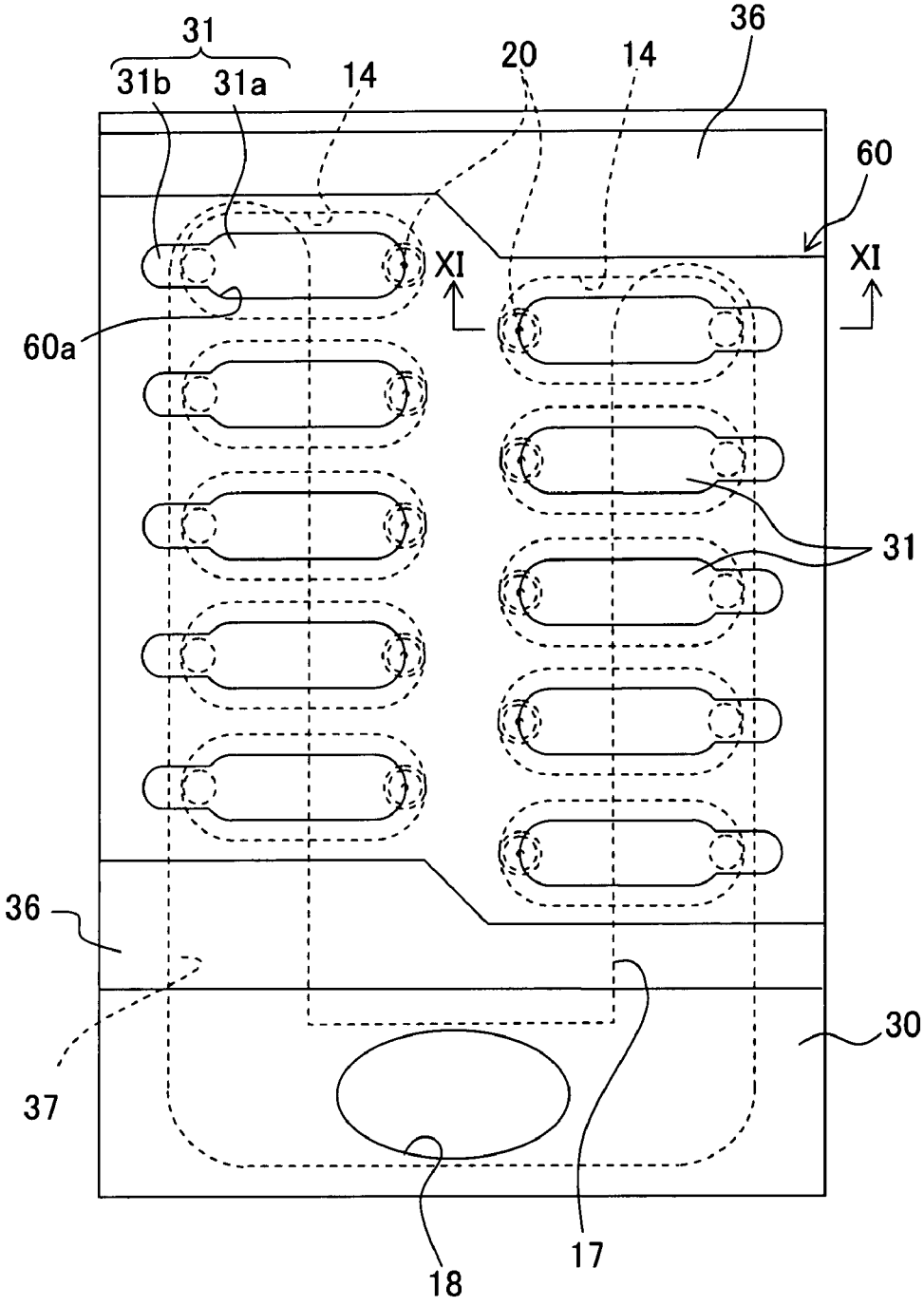
FIG. 10 is a plan view of the ink-jet head in a state where particles of a piezoelectric material are deposited on the upper surface of the vibration plate.
Figure 11:
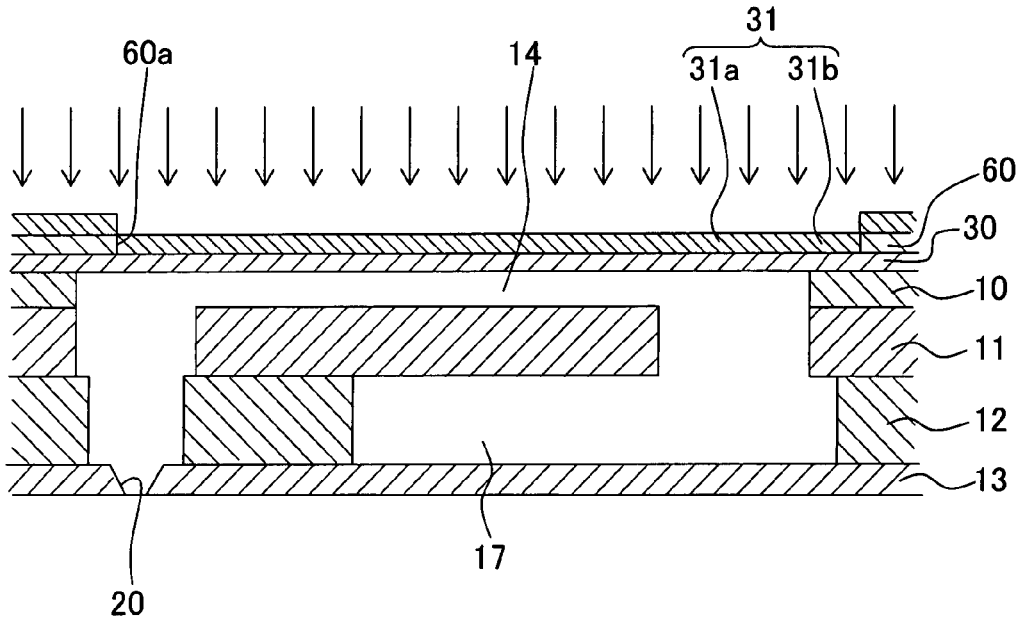
FIG. 11 is a cross-sectional view taken along line XI-XI in FIG. 10.
Figure 12:
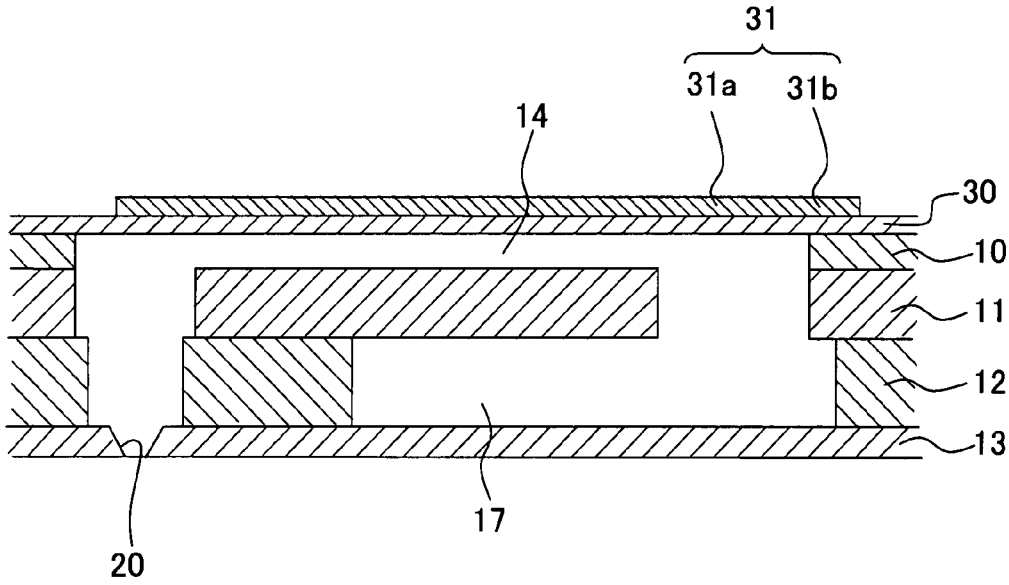
FIG. 12 is a cross-sectional view of the ink-jet head in a state where the mask is removed.

After the mask 60 is thus placed on the upper surface of the vibration plate 30, particles of the piezoelectric material are deposited on the upper surface of the vibration plate 30 covered by the mask 60 as shown in FIG. 10 and FIG. 11, and thereafter, as shown in FIG. 12, the mask 60 is removed from the vibration plate 30, so that the piezoelectric elements 31 each having the driving portion 31*a* and the contact arrangement portion 31*b* are formed on the areas on which the holes 60*a* of the mask 60 were disposed (element-forming step). Here, adaptable examples of a method of depositing the piezoelectric material on the upper surface of the vibration plate 30 are an aerosol deposition method (AD method) to spray aerosol containing fine particles and carrier gas to a substrate (vibration plate 30) to deposit the particles on the substrate, a sputtering method, a CVD (chemical vapor deposition) method, and the like. Since a ceramic material is used for the piezoelectric elements, the AD method capable of depositing such a material on predetermined portions is especially advantageous.

Here, since the length of the mask 60 in the arrangement direction of the pressure chambers 14 is shorter than the length of the vibration plate 30 as previously described, the particles of the piezoelectric material are deposited also on areas on the arrangement direction outer side of the areas facing the pressure chambers 14, and consequently, the two support sections 36 substantially equal in thickness to the piezoelectric elements 31 are formed on these areas as shown in FIG. 10. That is, on the upper surface of the vibration plate 30, this element-forming step not only discretely forms the piezoelectric elements 31, but also forms the two support sections 36 on the areas on the outer side of the piezoelectric elements 31. Since the piezoelectric elements 31 and the two support sections 36 made of the same piezoelectric material can thus be formed simultaneously, production processes are simplified.

Figure 13:
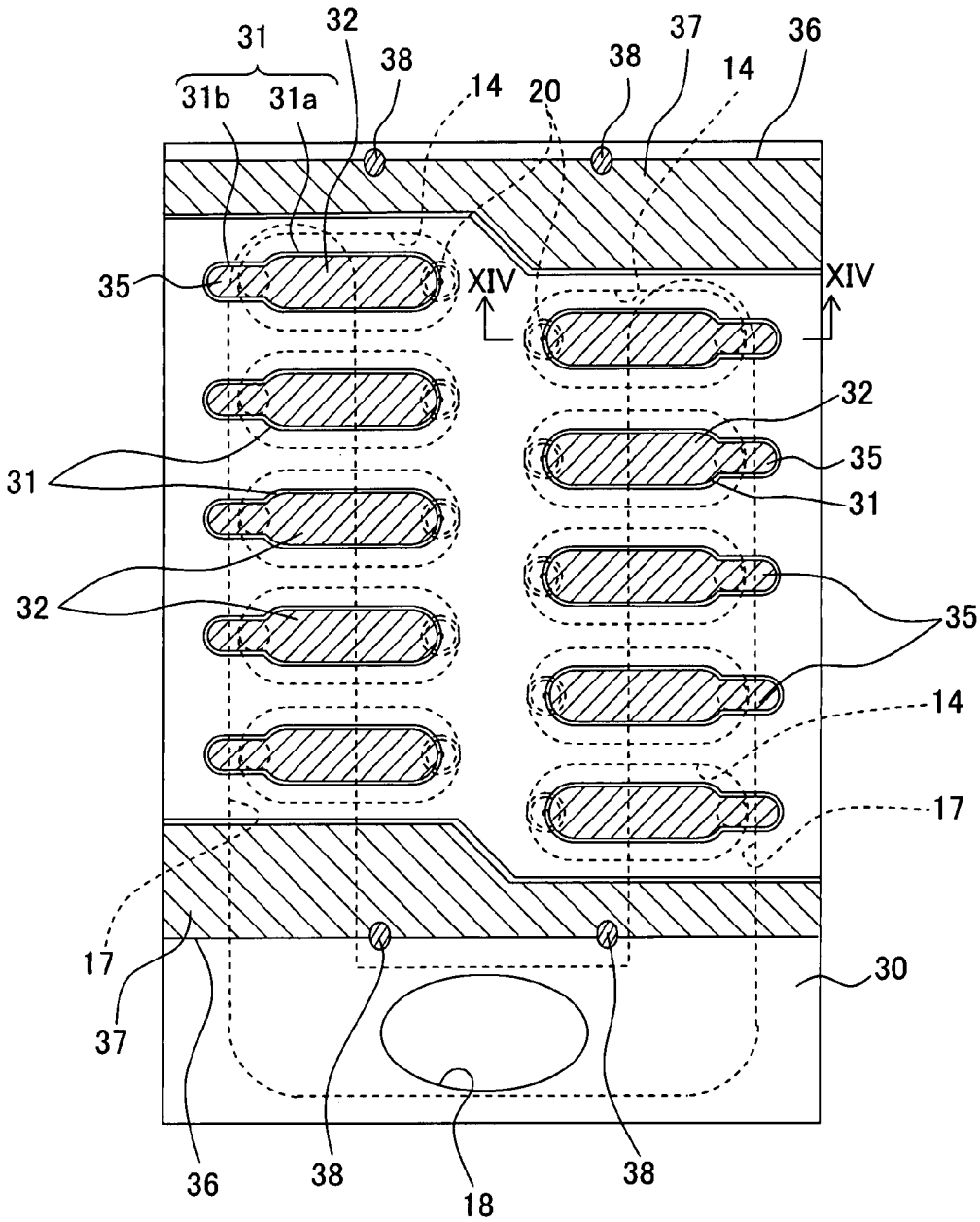
FIG. 13 is a plan view of the ink-jet head in a state where individual electrodes, contact portions, and surface electrodes are formed.
Figure 14:
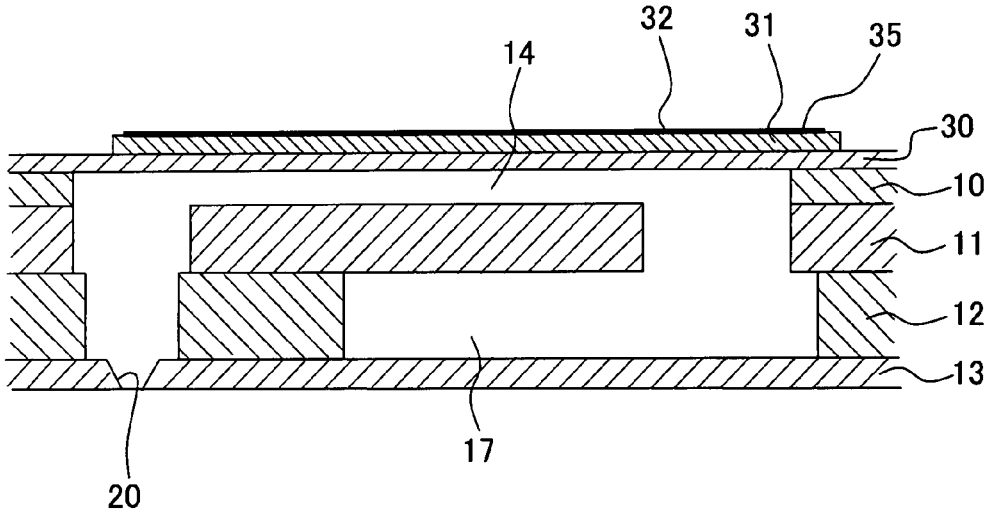
FIG. 14 is a cross-sectional view taken along line XIV-XIV in FIG. 13.

Next, as shown in FIG. 13 and FIG. 14, the individual electrodes 32 made of a conductive material and the contact portions 35 are formed on the upper surfaces of the driving portions 31*a* and the contact arrangement portions 31*b* of the piezoelectric elements 31 by screen printing, a vapor deposition method, or the like (electrode-forming step). At the same time, the surface electrodes 37 are also formed on the substantially entire upper surfaces of the two support sections 36. Further, on the outer end surfaces, of the two support sections 36, in the arrangement direction of the pressure chambers 14, the conduction parts 38 made of a conductive material are formed to extend from the surface electrodes 37 to the upper surface 30*a* of the vibration plate 30. Then, the surface electrodes 37 and the vibration plate 30 are made electrically conducted to each other by the conduction parts 38. Incidentally, either of the formation of the surface electrodes 37 and the formation of the conduction parts 38 may precede the other. That is, the conduction parts 38 may be formed after the surface electrodes 37 are formed on the upper surfaces of the support sections 36, or the surface electrodes 37 may be formed on the upper surfaces of the support sections 36 so as to come into contact with the conduction parts 38 after the conduction parts 38 are formed on the end surfaces of the support sections 36.

Figure 15:
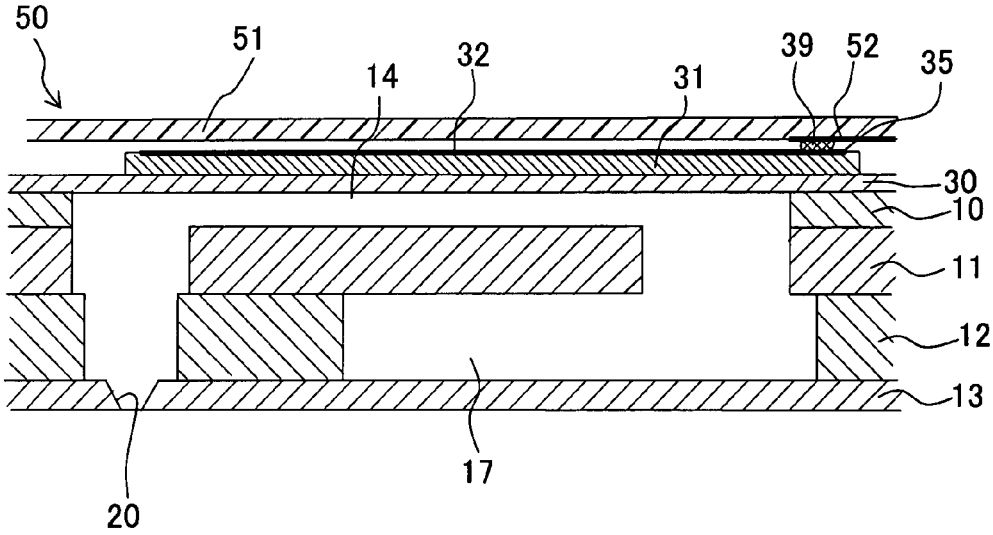
FIG. 15 is a cross-sectional view of the ink-jet head in a state where a FPC is connected.

Finally, as shown in FIG. 15, the flexible FPC 50 is disposed so as to cover the individual electrodes 32, and the wiring parts 52 formed on the lower surface of the substrate 51 of the FPC 50 are joined to the contact portions 35 formed on the upper surfaces 31*c* of the piezoelectric elements 31 by the solder 39, thereby electrically connecting the both (wiring-connecting step). Here, the tip portions of the contact portions 35 protrude across the peripheral edges of the pressure chambers 14 up to the highly stiff outer areas, and therefore, to join the wiring parts 52 of the FPC 50 to the contact portions 35 by the solder 39, it is allowed to sufficiently press the wiring parts 52, resulting in a good joining state of the both.

In this wiring-connecting step, among the wiring parts 52 of the FPC 50, those not connected to the contact portions 35 are electrically and mechanically joined to the surface electrodes 37 by the conductive adhesive 40 (see FIG. 2 and FIG. 5). Here, owing to the use of the thermosetting adhesive mainly composed of epoxy resin or the like as the adhesive 40, the heating and melting of the solder 39 and the heating and curing of the adhesive 40 can proceed simultaneously. That is, by simultaneously performing the joining of the FPC 50 and the individual electrodes 32 (contact portions 35) and the joining of the FPC 50 and the surface electrodes 37, it is possible to shorten the time required for these joining steps.

According to the ink-jet head 1 and the method of producing the same described hitherto, the following effects can be obtained.

On the upper surface 30*a* of the vibration plate 30, the two support sections 36 made of the same piezoelectric material as that of the piezoelectric elements 31 are provided on the areas located outside the pressure chambers 14, and the FPC 50 is joined to these two support sections 36. That is, the FPC 50 is joined to the piezoelectric actuator 5 not only at the connection portions (contact portions 35) with the individual electrodes 32 but also at the support sections 36. Therefore, the FPC 50 does not easily peel off from the piezoelectric actuator 5 when an external force acts on the FPC 50, resulting in enhanced reliability of the electrical connection necessary for applying the driving voltage to the individual electrodes 32. Further, production yields are improved since it can be prevented that the external force acting on the FPC 50 acts locally on a specific one of the piezoelectric elements 31 to break the piezoelectric element 31. In particular, since the support sections 36 are made of the same material as that of the piezoelectric elements 31, stress strain ascribable to a temperature change of the atmosphere is difficult to occur in the FPC 50, in the joining portions between the FPC 50 and the piezoelectric elements 31, and in the joining portions between the piezoelectric elements 31 and the vibration plate 30.

Further, owing to the adoption of the method of depositing the particles of the piezoelectric material on the upper surface of the vibration plate 30, production processes can be simplified since the piezoelectric elements 31 and the two support sections 36 made of the same piezoelectric material can be simultaneously formed.

Next, modified forms in which the above-described embodiment is variously changed will be explained. Those having the same structure as in the above-described embodiment will be denoted by the same reference numerals and symbols and explanation thereof will be omitted when appropriate.

First Modified Embodiment

Figure 16:
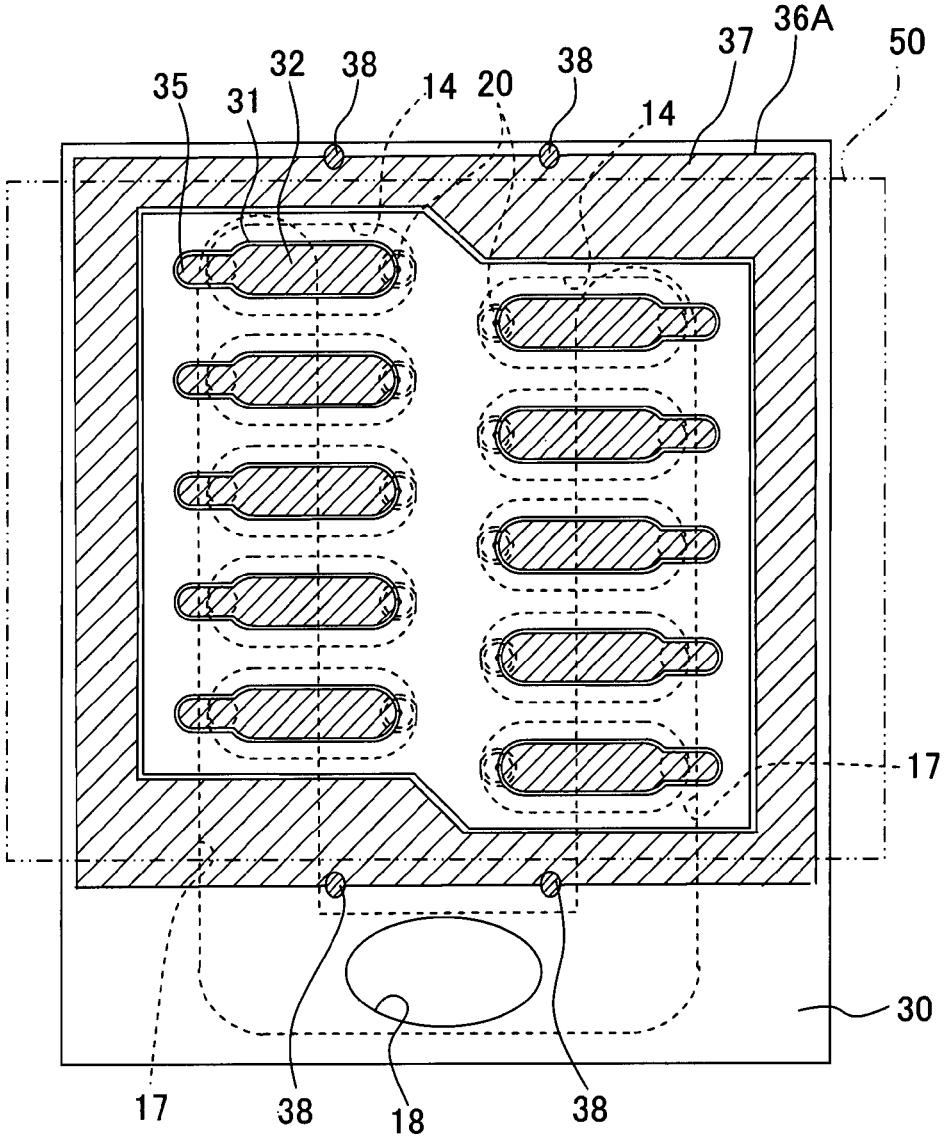
FIG. 16 is a plan view of an ink-jet head according to a modified form.

The arrangement positions of the support sections joined to the FPC may be appropriately changed within areas different from the areas facing the pressure chambers, in consideration of the arrangement of the piezoelectric elements, the channel structure, and so on. For example, as shown in FIG. 16, on the upper surface of the vibration plate 30, a support section 36A joined to the FPC 50 may be formed on an area surrounding the areas facing the pressure chambers 14 so as to surround the piezoelectric elements 31. This structure can more surely prevent the peeling of the FPC 50 since the FPC is fixed to the support section 36A on the whole periphery of the area on the outer side of the piezoelectric elements 31, that is, on the whole periphery of the area where a large external force easily acts on the FPC 50.

Alternatively, the FPC 50 may be joined to support sections, though not shown, disposed in areas between the piezoelectric elements 31. This structure can also provide some degree of the aforesaid effects of preventing the peeling of the FPC 50 and so on, as contrast to a structure without any support section.

Second Modified Embodiment

Figure 17:
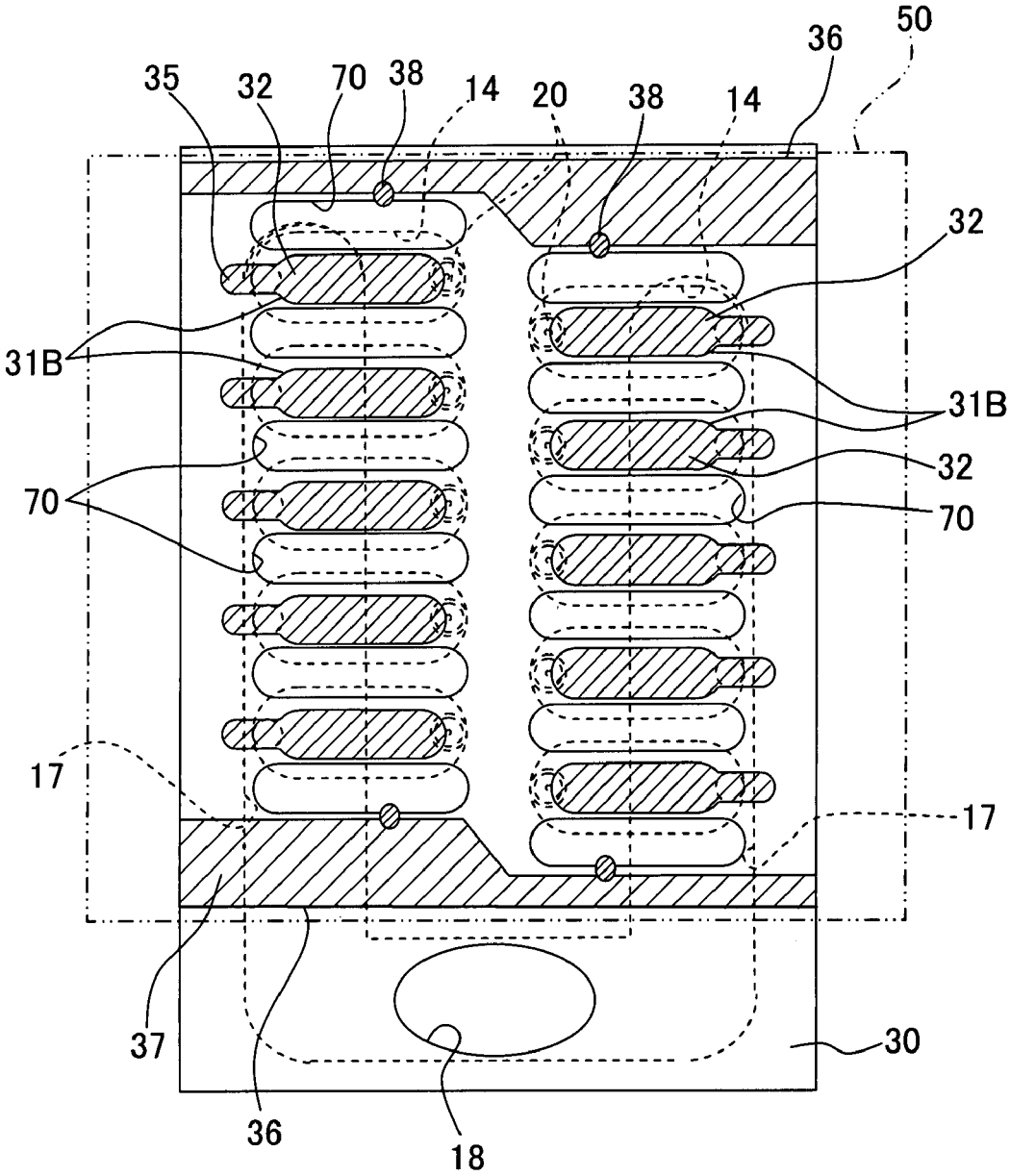
FIG. 17 is a plan view of an ink-jet head according to another modified form.

In the above-described embodiment, all the piezoelectric elements are disposed in a state where each of them is completely separated from surrounding ones, but adjacent piezoelectric elements may be connected to each other at part thereof. For example, as shown in FIG. 17, piezoelectric elements 31B arranged in the paper feeding direction may be partly separated from each other by holes 70 which are provided between these piezoelectric elements 31B to extend in the longitudinal direction of the pressure chambers 14. This structure can also reduce crosstalk since the deformation of the piezoelectric element does not easily spread to another piezoelectric element 31B adjacent thereto in the paper feeding direction. However, especially because no piezoelectric material layer along the FPC 50 exists in the feeding direction outer areas separating the piezoelectric elements 31B, a large external force easily acts on the FPC 50 and thus the FPC 50 easily peels off. Therefore, by applying the present invention to such a structure to provide the support sections 36 on the areas on the paper feeding direction outer side of the piezoelectric elements 31B and mechanically join the FPC 50 to the support sections 36, it is possible to prevent the peeling of the FPC 50 and the breakage of the piezoelectric elements 31B as in the above-described embodiment.

Third Modified Embodiment

The vibration plate 30 as the common electrode does not necessarily have to be kept at the ground potential via the FPC 50, and may be kept at the ground potential by other structure. In this case, neither the surface electrodes 37 on the upper surfaces of the support sections 36 nor the conduction parts 38 are necessary, and it is only necessary that the support sections 36 are mechanically joined to the FPC 50 by an adhesive or the like.

Fourth Modified Embodiment

The vibration plate 30 does not necessarily have to serve as the common electrode, and a common electrode made of a conductive material may be formed without any gap on the upper surface 30*a* of the vibration plate 30 separately from the vibration plate 30. In this case, at least the upper surface of the vibration plate has to be insulated.

Fifth Modified Embodiment

In the above-described embodiment, the individual electrodes 32 are disposed on the upper surfaces 31*c* of the piezoelectric elements 31, and the driving voltage is applied selectively to the individual electrodes 32 via the FPC 50 (see FIG. 2 to FIG. 5), but the arrangement relation of the electrodes to which the driving voltage is applied and the electrodes kept at the ground potential may be reversed. Specifically, such a structure may be adopted that electrodes to which the driving voltage is selectively applied (electrodes corresponding to the individual electrodes 32 in the above-described embodiment) are disposed on an upper surface of an insulative vibration plate, the FPC is connected to electrodes disposed on the piezoelectric elements respectively (electrodes corresponding to the common electrode), and the electrodes on the upper surfaces of the piezoelectric elements are constantly kept at the ground potential via the FPC.

Sixth Modified Embodiment

In the producing method of the above-described embodiment, to form the piezoelectric elements 31 and the support sections 36, the particles of the piezoelectric material are deposited on the upper surface 30*a* of the vibration plate 30

(see FIG. 10 and FIG. 11), but the method of forming the piezoelectric elements and the support sections is not limited to this method. As an example, adoptable is a method in which the piezoelectric elements and the support sections are formed by using cut portions of a piezoelectric sheet obtained by sintering a green sheet, and these piezoelectric elements and the support sections are joined to the upper surface of the vibration plate individually by an adhesive or the like. Alternatively, after a piezoelectric sheet is pasted on the upper surface of the vibration plate, this piezoelectric sheet may be cut into a plurality of piezoelectric elements and support sections.

The embodiment and its modified forms described above are examples where the present invention is applied to the ink-jet head jetting an ink from the nozzles, but the application of the present invention is not limited to such an ink-jet head. For example, the present invention is applicable to various liquid jetting apparatuses for forming a fine wiring pattern on a substrate by jetting conductive paste, for forming a high-definition display by jetting an organic light emitting material to a substrate, and for forming a microscopic electronic device such as an optical waveguide by jetting optical resin to a substrate.

The present invention is applicable not only to liquid jetting apparatuses but also to any liquid transporting apparatus that transports a liquid in pressure chambers by using a piezoelectric actuator and in which electrodes of the piezoelectric actuator are joined to a wiring member. The present invention is also applicable to a liquid transporting apparatus transporting a liquid other than an ink, for example, a liquid transporting apparatus transporting a liquid such as a liquid chemical or a biochemical solution in a micro total analysis system (μTAS), a liquid transporting apparatus transporting a liquid such as a solvent or a chemical solution in a microchemical system, and the like.

What is claimed is:

1. A liquid transporting apparatus comprising:

a channel unit in which a liquid channel including a plurality of pressure chambers arranged along a plane is formed;

a piezoelectric actuator which applies a pressure to a liquid in the pressure chambers and which includes:

a vibration plate disposed on the channel unit to cover the pressure chambers;

a plurality of piezoelectric elements disposed on a surface, of the vibration plate, not facing the pressure chambers;

a first electrode disposed on the surface, of the vibration plate, which is in contact with the piezoelectric elements; and second electrodes disposed on surfaces, of the piezoelectric elements, opposite to surfaces in contact with the vibration plate; and a flexible wiring member physically connected to the second electrodes;

wherein each of the piezoelectric elements is disposed to face one of the pressure chambers corresponding thereto and the piezoelectric elements are arranged to be isolated from each other;

wherein a support section is arranged on the surface, of the vibration plate, not facing the pressure chambers, at an area different from another area facing the pressure chambers, the support section being made of a piezoelectric material same as that of the piezoelectric elements, and the support section being separate and distinct from the plurality of piezoelectric elements; and wherein a surface of the support section which does not face the vibration plate is physically joined to the flexible wiring member to physically support the flexible wiring member.

2. The liquid transporting apparatus according to claim 1;

wherein the area at which the support section is arranged is outside the another area facing the pressure chambers.

3. The liquid transporting apparatus according to claim 2;

wherein the area at which the support section is arranged surrounds the another area facing the pressure chambers.

4. The liquid transporting apparatus according to claim 1;

wherein the first electrode is a common electrode of the piezoelectric elements, formed without any gap on the surface, of the vibration plate, not facing the pressure chambers; and wherein the second electrodes are individual electrodes of the piezoelectric elements respectively.

5. The liquid transporting apparatus according to claim 4;

wherein the vibration plate has a conductive surface as the common electrode provided on the surface, of the vibration plate, not facing the pressure chambers;

wherein a surface electrode is formed on the surface of the support section not facing the vibration plate, and the surface electrode is electrically conducted with the conductive surface of the vibration plate; and wherein the wiring member is electrically connected to the surface electrode.

6. The liquid transporting apparatus according to claim 1;

wherein the wiring member is joined to the surface, of the support section, not facing the vibration plate with a thermosetting adhesive.

7. The liquid transporting apparatus according to claim 6;

wherein the thermosetting adhesive is electrically conductive.

8. The liquid transporting apparatus according to claim 1;

wherein the support section extends in an extending direction which is a longitudinal direction of the wiring member.

9. The liquid transporting apparatus according to claim 8;

wherein a width of the support section in an orthogonal direction orthogonal to the extending direction of the support section varies in the extending direction of the support section.

10. The liquid transporting apparatus according to claim 1, which is an ink-jet head.

11. A method of producing a liquid transporting apparatus including a piezoelectric actuator, the method comprising:

a step of preparing a channel unit having a liquid channel including a plurality of pressure chambers which are arranged along a plane;

a step of disposing a vibration plate on the channel unit to cover the pressure chambers;

an element-forming step of forming a plurality of piezoelectric elements which are isolated from each other by discretely depositing particles of a piezoelectric material on a surface, of the vibration plate, not facing the pressure chambers;

a first electrode-forming step of forming a first electrode on the surface, of the vibration plate, which is in contact with the piezoelectric elements;

a second electrode-forming step of forming second electrodes on surfaces, of the piezoelectric elements, opposite to surfaces of the piezoelectric elements which are in contact with the vibration plate; and a wiring-connecting step of physically connecting a flexible wiring member to the second electrodes;

wherein in the element-forming step, a support section made of a piezoelectric material same as that of the piezoelectric elements is formed on the surface, of the vibration plate, not facing the pressure chambers simultaneously with the formation of the piezoelectric elements, the support section being separate and distinct from the plurality of piezoelectric elements; and wherein, in the wiring-connecting step, the wiring member is physically joined to a surface, of the support section, not facing the vibration plate, together with the connection of the wiring member to the second electrodes, so that the support section physically supports the flexible wiring member.

12. The method of producing the liquid transporting apparatus according to claim 11;

wherein, in the element-forming step, the support section is formed on an area, of the vibration plate, located at outside another area, of the vibration plate, facing the pressure chambers.

13. The method of producing the liquid transporting apparatus according to claim 11;

wherein the first electrode is formed without any gap on the surface, of the vibration plate, not facing the pressure chambers and is a common electrode of the piezoelectric elements;

wherein the second electrodes are individual electrodes of the piezoelectric elements respectively;

wherein the vibration plate has a conductive surface as the common electrode, on a side opposite to the pressure chambers;

wherein, in the second electrode-forming step, a surface electrode is formed on the surface, of the support section, not facing the vibration plate, together with the formation of the individual electrodes, and a conduction part via which the surface electrode and the conductive surface of the vibration plate are electrically conducted is formed; and wherein, in the wiring-connecting step, the wiring member and the surface electrode are electrically connected.

14. The method of producing the liquid transporting apparatus according to claim 11;

wherein, in the wiring-connecting step, a thermosetting adhesive is used to join the wiring member to the surface, of the support section, not facing the vibration plate.

15. The method of producing the liquid transporting apparatus according to claim 14;

wherein the thermosetting adhesive is electrically conductive.

16. The method of producing the liquid transporting apparatus according to claim 11;

wherein the support section is formed to extend in an extending direction which is a longitudinal direction of the wiring member.

17. The method of producing the liquid transporting apparatus according to claim 16;

wherein a width of the support section in an orthogonal direction orthogonal to the extending direction of the support section varies in the longitudinal direction.

18. The method of producing the liquid transporting apparatus according to claim 11;

wherein the liquid transporting apparatus is an ink-jet head.

19. The liquid transporting apparatus according to claim 1;

wherein the flexible wiring member is disposed above the pressure chamber.

20. The method of producing the liquid transporting apparatus according to claim 11;

wherein the flexible wiring member is disposed above the pressure chamber.

21. The liquid transporting apparatus according to claim 3;

wherein the flexible wiring member is fixed to the support section on the area surrounding the another area facing the pressure chamber.

* * * * *